US005927954A

United States Patent [19]

Kennedy et al.

[11] Patent Number: 5,927,954

[45] Date of Patent: Jul. 27, 1999

[54] AMPLIFIED PRESSURE AIR DRIVEN DIAPHRAGM PUMP AND PRESSURE RELIEF VALUE THEREFOR

[75] Inventors: Dennis E. Kennedy, Fontana; Wilfred D. Pascual, Baldwin Park, both of Calif.

[73] Assignee: Wilden Pump & Engineering Co., Grand Terrace, Calif.

[21] Appl. No.: 08/842,377

[22] Filed: Apr. 23, 1997

Related U.S. Application Data

[63] Continuation of application No. 08/649,543, May 17, 1996

[60] Provisional application No. 60/058,208.

[51] Int. Cl.[6] ..... F04B 17/00

[52] U.S. Cl. ..... 417/397; 417/395

[58] Field of Search ..... 417/395, 397; 92/93

[56] References Cited

U.S. PATENT DOCUMENTS

| | | | |
|---|---|---|---|
| D. 275,858 | 10/1984 | Wilden | D15/7 |
| D. 294,946 | 3/1988 | Wilden | D15/7 |
| D. 294,947 | 3/1988 | Wilden | D15/7 |
| 3,043,227 | 7/1962 | Everett | 92/93 |
| 3,583,431 | 6/1971 | Diel | 137/474 |
| 4,008,984 | 2/1977 | Scholle | 417/393 |
| 4,104,008 | 8/1978 | Hoffmann et al. | 417/397 |
| 4,247,264 | 1/1981 | Wilden | 417/393 |
| 4,381,180 | 4/1983 | Sell | 417/393 |
| 4,549,467 | 10/1985 | Wilden et al. | 91/307 |
| 4,778,356 | 10/1988 | Hicks | 417/397 |
| 4,830,586 | 5/1989 | Herter et al. | 417/395 |
| 4,981,418 | 1/1991 | Kingsford et al. | 417/63 |
| 5,169,296 | 12/1992 | Wilden | 417/395 |
| 5,174,731 | 12/1992 | Korver | 417/393 |
| 5,213,485 | 5/1993 | Wilden | 417/393 |
| 5,415,531 | 5/1995 | Cavanaugh | 417/397 |
| 5,647,733 | 7/1997 | Augustyn et al. | 417/360 |

FOREIGN PATENT DOCUMENTS 1126737 3/1962 Germany .

*Primary Examiner*—Charles G. Freay
*Attorney, Agent, or Firm*—Lyon & Lyon LLP

[57] ABSTRACT

An air driven diaphragm pump having two, opposed pumping cavities. A center section assembly between the pumping cavities includes a cylinder and a power amplifier piston. The power amplifier piston as well as the diaphragms are coupled with a common control shaft. A valve assembly is arranged with a manifold to receive pressurized air and distribute that air in alternating fashion to the sides of the power amplifier piston as well as to each of the diaphragms. By directing pressure to a side of the power amplifier piston facing the same direction as the diaphragm receiving pressure, an amplified pressure on a pump chamber is experienced. With the power amplifier piston being approximately twice as large as the diaphragm assembly, an amplification of three times the is pressure on the pump chamber is experienced. Both pump chambers are able to operate to pump material. A relief valve includes an actuator and a valve element which cooperate through a compression spring and stops to provide a force profile for valve actuation and energy for positive actuation. Both the compression spring and a return spring are configured for longevity through a great number of cycles. Blocks of elastomeric material are disclosed.

44 Claims, 12 Drawing Sheets

AMPLIFIED PRESSURE AIR DRIVEN DIAPHRAGM PUMP AND PRESSURE RELIEF VALUE THEREFOR

As to the subject matter which is common, this is a continuing application of U.S. application Ser. No. 08/649,543, filed May 17, 1996, now converted to a Provisional application Ser. No. 60/058,208, now expired.

BACKGROUND OF THE INVENTION

The field of the present invention is pneumatic mechanisms including reciprocating air driven devices such as air driven diaphragm pumps and valving for such devices.

Pumps having double diaphragms driven by compressed air directed through an actuator valve are well known. Reference is made to U.S. Pat. Nos. 5,213,485; 5,169,296; and 4,247,264; and to U.S. Pat. Nos. Des. 294,946; 294,947; and 275,858. An actuator valve using a feedback control system is disclosed in U.S. Pat. No. 4,549,467. The disclosures of the foregoing patents are incorporated herein by reference.

Common to the aforementioned patents on air driven diaphragm pumps is the presence of two opposed pumping cavities. The pumping cavities each include a pump chamber housing, an air chamber housing and a diaphragm extending fully across the pumping cavity defined by these two housings. Each pump chamber housing includes an inlet check valve and an outlet check valve. A common shaft typically extends into each air chamber housing to attach to the diaphragms therein. An actuator valve receives a supply of pressurized air and operates through a feedback control system to alternately pressurize and vent the air chamber side of each pumping cavity. Feedback to a valve piston is typically provided by the shaft position.

The aforementioned pumps are limited by the magnitude of the inlet air pressure. Even so, such pumps have found great utility in the pumping of many and varied liquids and even powders. Conveniently, shop air is frequently the source of pressure, typically running in the 80 psi to 90 psi range. Naturally, some applications would be advantaged or even made possible by increased pumping pressure. Such applications include long process piping, extremely viscous product pumping, such as automotive paints and paint base compounds, and high compaction filter press operations. Such filter press operations are becoming more and more common with the imposition of stricter environmental regulations requiring the solids in liquid waste to be filtered to a solid waste for safe handling, transportation and disposal. Higher pressures aid in these operations.

A number of enhanced pressure air driven diaphragm pumps are available. These pumps typically rearrange the passages of a conventional air driven diaphragm pump such as described above in a manner that allows one of the two pumping chambers to continue to function in that capacity while the other is used as a further air chamber for magnifying the pumping pressure. To this end, the valves in one of the pump chamber housings are blanked off with a blind seat, plugs or specially constructed chamber. Pressurized air is then introduced to the pump chamber side of the diaphragm in the specially prepared pumping cavity. This pressure is provided at the same time that air pressure is provided to the air chamber side of the unmodified pumping cavity. In this way, a single pumping chamber is provided which is subject to twice the compressive pressure as would otherwise be supplied in a conventional air driven diaphragm pump. However, the ability to pump on each stroke is lost and flow rate is reduced. Such pumps create pressure imbalances with possible components failure.

Pumps employing a single pumping cavity have also been modified with amplified air pressure through the provision of an adjacent cylinder with air pressure alternately provided to opposing sides of an included piston. Air pressure is again provided to the air chamber side of the pumping diaphragm.

Pressure relief valves are also known. Such devices include valve bodies with actuator pins extending therefrom to lift a valve element off of a seat. A flow path through the valve body extends across the valve seat such that flow may be controlled by the valve element which is in turn controlled by the force on the actuator pin. Return springs are used to seat the valve when not lifted from the seat by the actuator pin.

SUMMARY OF THE INVENTION

The present invention is directed to an air driven double diaphragm pump having two pumping cavities with a pumping cavity associated with each diaphragm, respectively. Even with both pumping cavities operating as such, an amplified pressure system is provided.

In a first, separate aspect of the present invention, the pressure amplified double diaphragm pump includes a center section assembly having a cylinder with a power amplifier piston contained therein. The piston is fixed to the control shaft assembly. Pressure may be alternately presented to each side of the power amplifier piston to work in conjunction with pressure supplied alternately to the air chamber sides of the pumping cavities. Each stroke of the shaft provides amplified pressure pumping. The size of the power amplifier piston is independent of the size of the diaphragms and may be larger than the pump diaphragms so long as the pump diaphragms are able to withstand the actual pumping pressures.

In a second, separate aspect of the present invention, the pressure amplified double diaphragm pump again includes a center section assembly having a cylinder within which a power amplifier piston is contained to stroke with the pump shaft. A valve assembly providing alternating pressure to the piston surfaces includes two pressure relief valves associated with the center section assembly, each including an actuator. The actuators are arranged such that the relief valves are actuated at preselected limits of the piston stroke. The relief valves operate to control a valve piston within the valve assembly which in turn controls air to the piston surfaces. Ease of location and avoidance of interference in the pumping cavities results from this configuration.

In a third, separate aspect of the present invention, the relief valve of the second separate aspect includes a compression spring between the valve element and the actuator. The compression spring accumulates energy to insure a positive opening of the valve with movement of the actuator.

In a fourth, separate aspect of the present invention, the relief valve of the second separate aspect includes a return spring having the characteristic of an advantageous displacement/force relationship and the ability to withstand a great number of cycles in operation. Installed, the return spring assumes a dome shape and elastomeric material may be employed.

In a fifth, separate aspect of the present invention, the relief valve of the second separate aspect employs the energy storage capacity of a compression spring with the force transmission characterics of a solid link in opposition to pressure to provide a positive opening characteristic to a valve element.

In a sixth, separate aspect of the present invention, a compression spring between a valve element and an actuator in a relief valve of the second separate aspect is configured for extended longevity. A block of resilient material is located within a rigid seat to provide the ability to withstand a great number of cycles of the valve without disabling component wear and fatigue failure.

In a seventh, separate aspect of the present invention, one or more of the foregoing separate aspects may be combined to positive advantage.

Accordingly, it is an object of the present invention to provide improved pneumatic equipment. Other and further objects and advantages will appear hereinafter.

DETAILED DESCRIPTION OF THE PREFERRED EMBODIMENT

Figure 1:
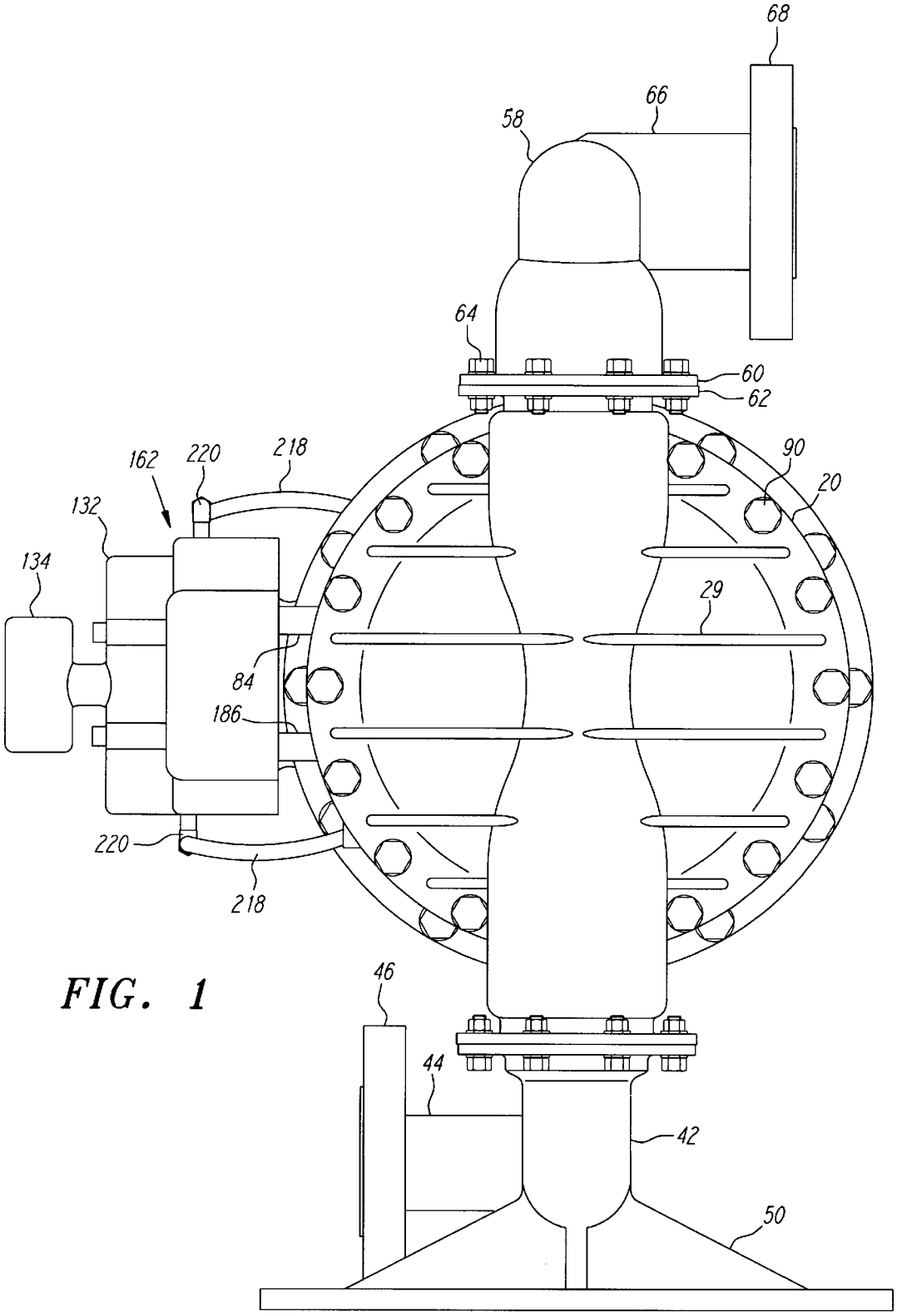
FIG. 1 is an end view of a amplified pressure air driven diaphragm pump.
Figure 2:
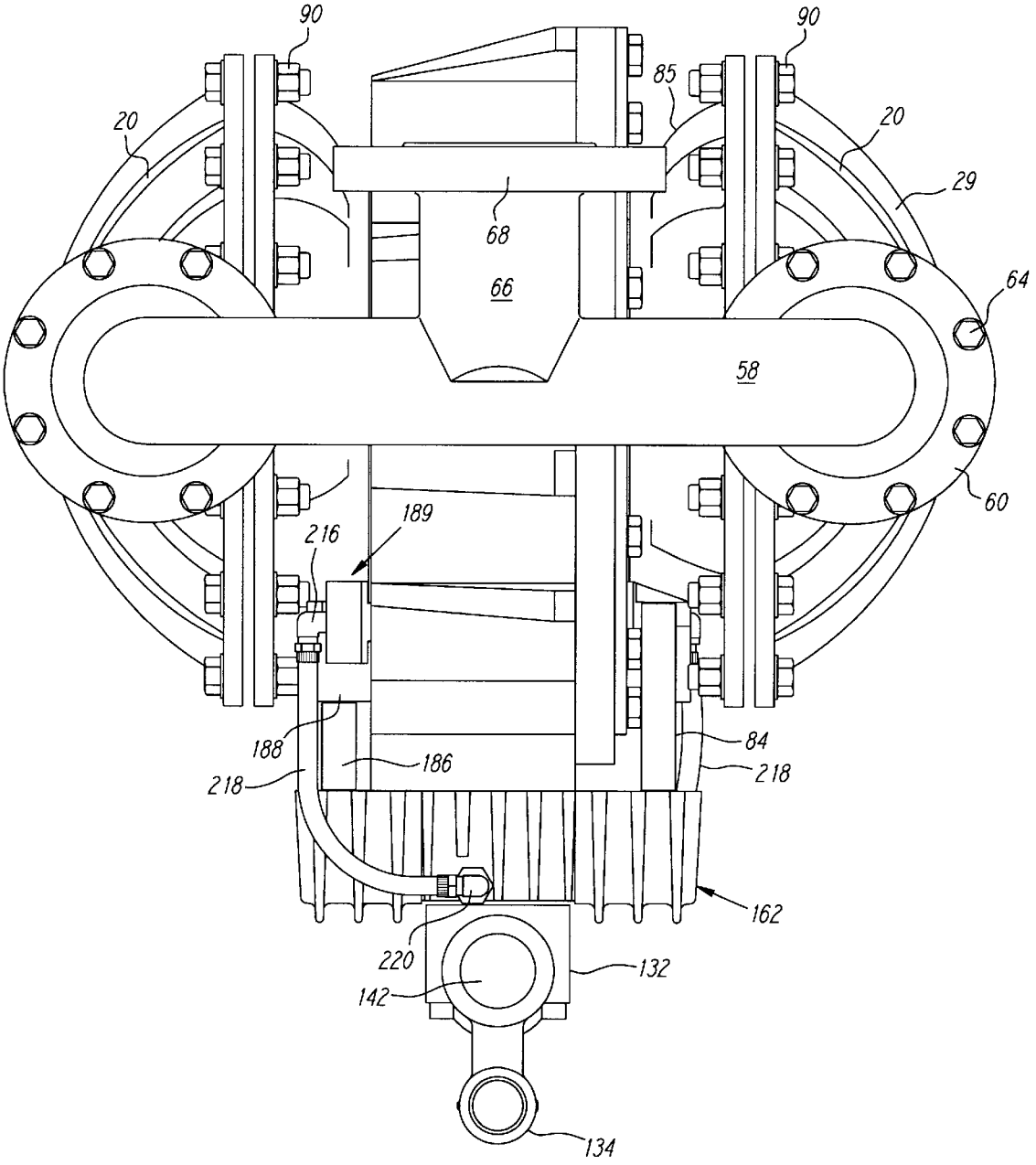
FIG. 2 is a top view of the pump of FIG. 1.
Figure 3:
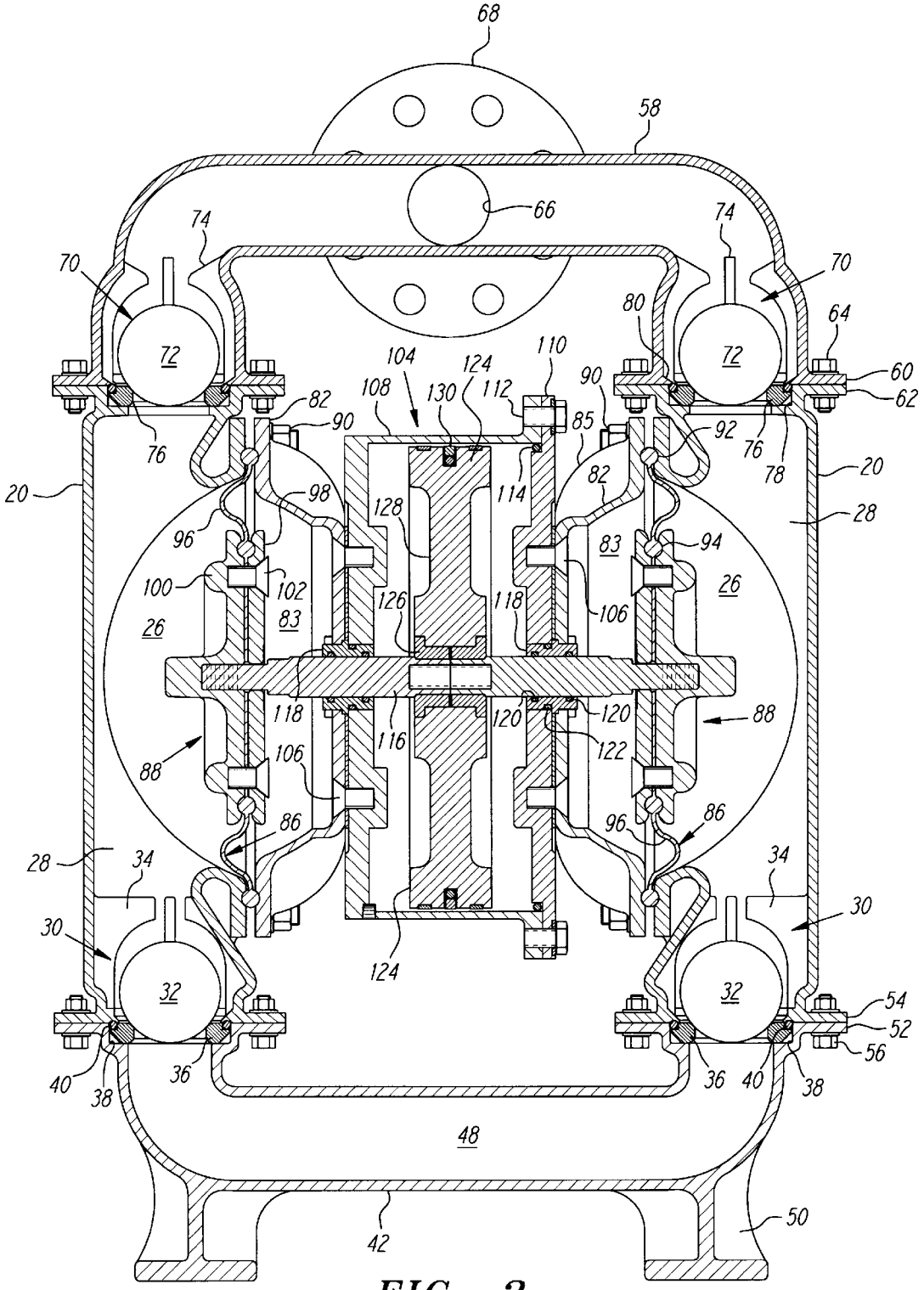
FIG. 3 is a cross-sectional side view of the pump of FIG. 1.
Figure 4:
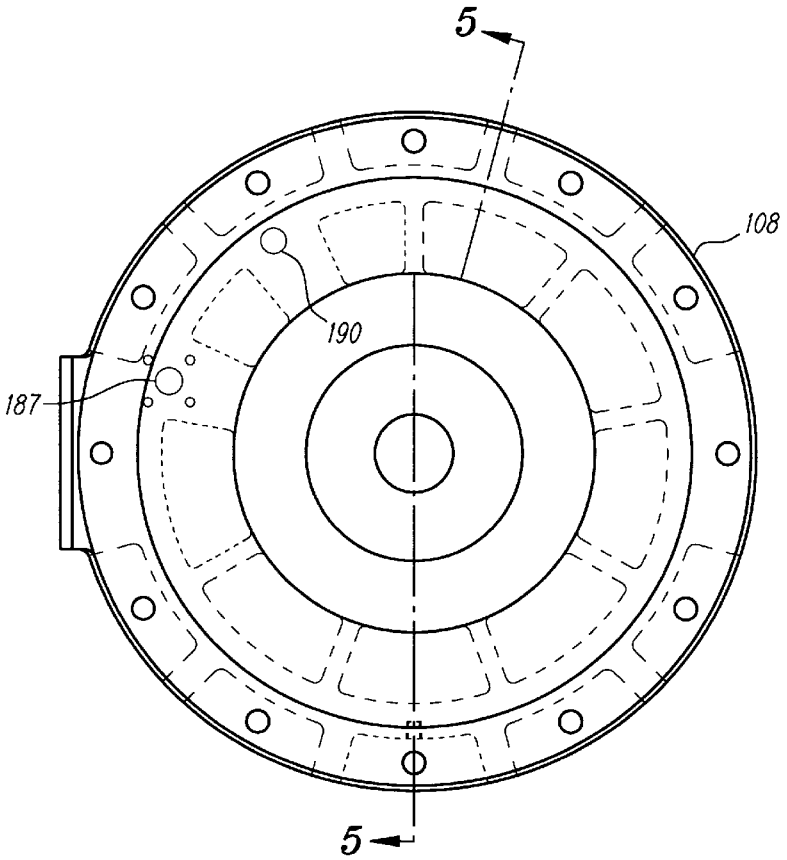
FIG. 4 is a front view of the interior of the cylindrical housing of the center section.
Figure 5:
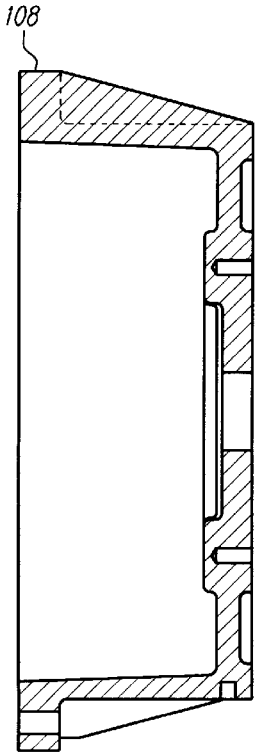
FIG. 5 is a cross-sectional view taken along line 5—5 of FIG. 4.
Figure 7:
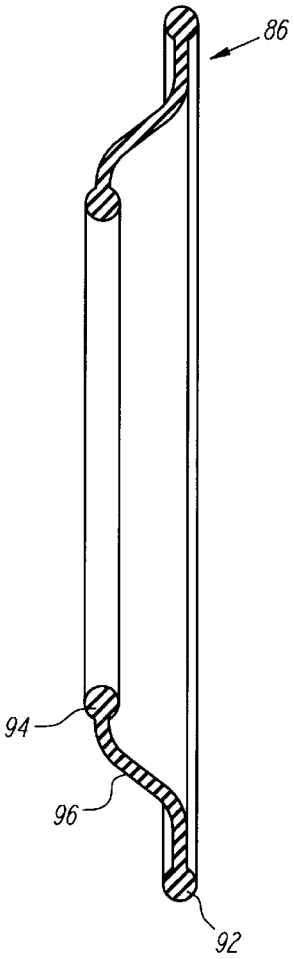
FIG. 7 is a cross-sectional view of the diaphragm of FIG. 6 taken along line 7—7 of FIG. 6.
Figure 6:
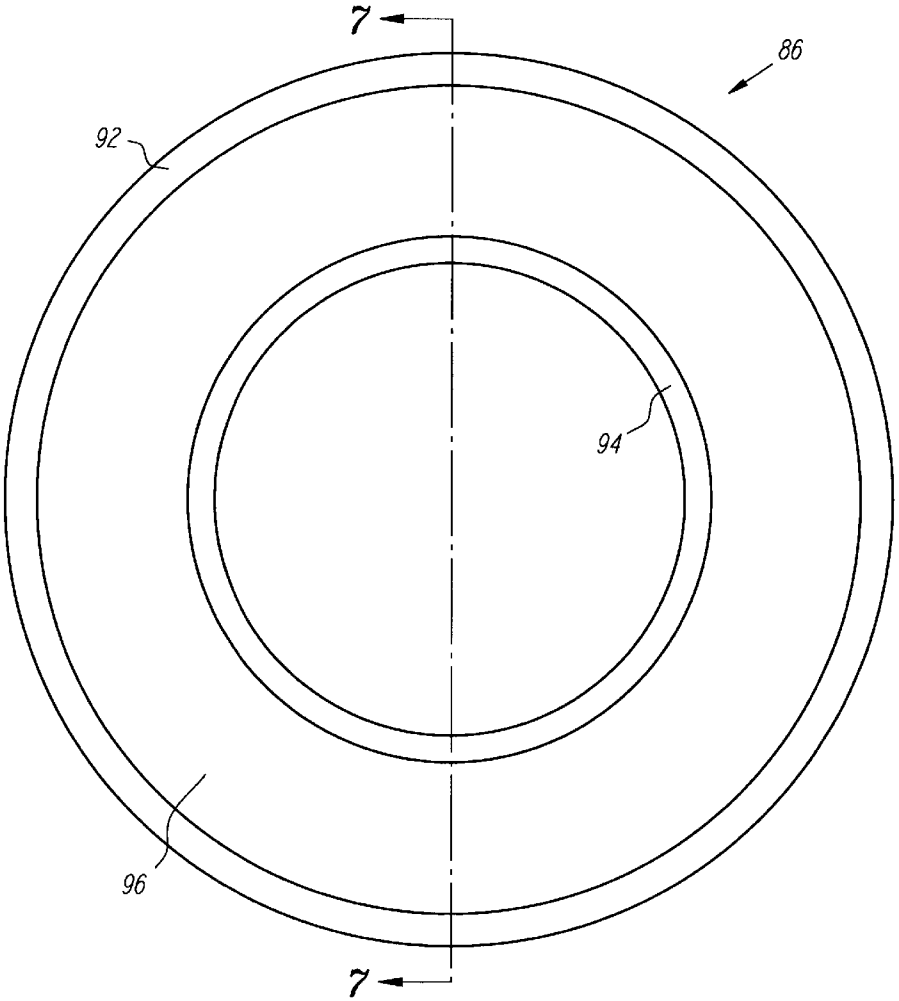
FIG. 6 is a plan view of a pump diaphragm.
Figure 8:
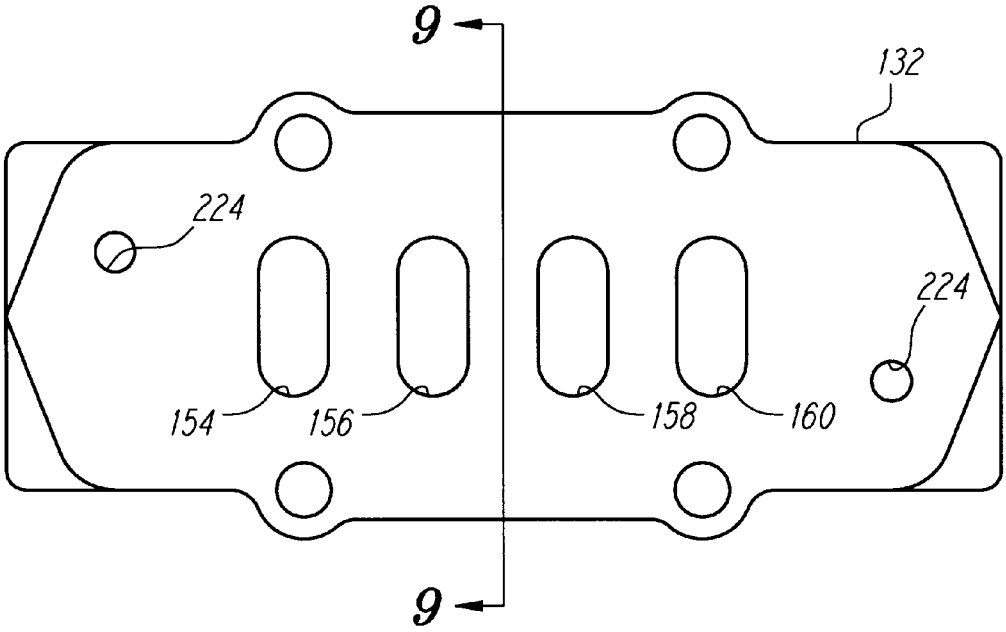
FIG. 8 is a plan view of a valve cylinder.

Turning in detail to the drawings, FIGS. 1–3 illustrate an amplified pressure double diaphragm pump. Two opposed pumping cavities are arranged to either side of the pump. Each cavity is partially defined by a pump chamber housing 20. Each pump chamber housing 20 includes a dome shaped cavity 26 intersected by a substantially cylindrical passage 28. Strengthening ribs 29 are found on the outside of each housing 20. An inlet check valve, generally designated 30, includes a ball 32 constrained by retainers 34 and cooperating with a valve seat 36. The retainers 34 are structurally located within the cylindrical passage 28 of the pump chamber housings 20. The valve seat 36 on the inlet check valve 30 is conveniently arranged within an adjacent cylindrical cavity 38. The seat 36 includes an annular notch to receive an O-ring 40 which is softer than the valve seat 36 to prevent pressurized flow around the seat.

An inlet manifold 42 provides the adjacent cylindrical cavity 38 of the inlet check valve 30 associated with each pump chamber housings 20. The manifold 42 includes an inlet 44 with an attachment flange 46. A passageway 48 extends to each opposed cavity 26. Support feet 50 are conveniently formed with the inlet manifold 42 to allow stable positioning of the pump. The inlet manifold 42 and the pump chamber housings 20 each include mounting flanges 52 and 54, respectively. Fasteners 56 associated with the flanges 52 and 54 provide a high pressure joint to resist leakage. The O-rings 40 are also positioned to compress under pressure against the part line between the flanges 52 and 54 to further avoid leakage.

An outlet manifold 58 is positioned at the upper end of the pump chamber housings 20 in alignment with the cylindrical passage 28. Mating flanges 60 and 62 are associated with the outlet manifold 58 and the pump chamber housings 20, respectively. Fasteners 64 retain the components in position. The manifold includes an outlet 66 having an attachment flange 68.

Outlet check valves, generally designated 70, associated with the pump chamber housings 20 are constructed in a manner similar to that of inlet check valves 30. Balls 72 are retained by retainers 74 located within the outlet manifold 58. Valve seats 76 are positioned in cylindrical cavities 78 located in the upper portion of each pump chamber housing 20. The valve seats 76 include O-rings 80 as in the case of the inlet check valves 30.

Two air chamber housings 82 are positioned inwardly of the opposed pump chamber housings 20. The air chamber housings 82 each provide a concave air chamber cavity 83 to closely receive the pumping mechanism located within the opposed pumping cavities when at one end of the stroke so as to minimize air usage. An inlet to each air chamber cavity 83 is provided through a stainless tube 84. Strengthening and cooling ribs 85 are located on the outer surface of the air chamber housing 82.

Bisecting the opposed pumping cavities are two diaphragms, generally designated 86, in association with a control shaft assembly including two diaphragm pistons, generally designated 88. Each of the pump chamber housings 20 and the air chamber housings 82 includes an annular groove for receipt of a diaphragm 86. The grooves are located on mating surfaces between corresponding pump chamber housings 20 and air chamber housings 82 such that fasteners 90 may compress the components together to securely retain an outer, annular bead 92 on each diaphragm 86. Inner beads 94 are similarly retained by the diaphragm pistons 88. Between the beads 92 and 94, a thin walled annular diaphragm body 96 accommodates flexure and the pressure of both the operating air and the pumped material.

The diaphragm pistons 88 each include an inner piston element 98 and an outer piston element 100. These elements 98 and 100 are securely drawn together by fasteners 102 to ensure clamping of the inner bead 94 of each diaphragm 86.

Located between the opposed pumping cavities and fastened to the air chamber housings 82 is a center section assembly, generally designated 104. The center section assembly is attached to each air chamber housing 82 by fasteners 106. The center section assembly 104 is shown to include a cylindrical housing 108 and an end plate 110. The end plate 110 is retained on the cylindrical housing 108 by fasteners 112. An O-ring 114 provides sealing at the part line between the cylindrical housing 108 and the end plate 110. Defined within the center section assembly is a cylinder.

In addition to the diaphragm pistons 88, the control shaft assembly includes a control shaft 116. The control shaft 116 is shown to be fabricated in two parts with a threaded stud linking the two. Each end of the shaft 116 is threaded so as to be received and fixed to the diaphragm pistons 88. This arrangement causes the diaphragm pistons 88 and the diaphragms 86 to move together. The shaft extends through seals 118 which are associated with both the center section assembly 104 and the air chamber housings 82 as can best be seen in FIG. 3. O-rings 120 provide sliding seals while an O-ring 122 provides a static seal on each of the seals 118.

Located within the cylindrical interior of the center section assembly 104 and fixed to the control shaft 116 is a power amplifier piston 124. This piston is captured between shoulders on each shaft portion. The power amplifier piston 124 is shown to include a center bushing 126, a piston body 128 and peripheral piston rings 130 for sealing the piston against the inner wall of the cylindrical housing 108. The control shaft 116, the power amplifier piston 124, and the cylindrical housing 108 are most conveniently concentrically arranged about a center axis.

To provide power to the pump, a valve assembly is associated with the pump. The valve assembly includes a valve body 132. Leading to the valve body 132 is a filter 134 to receive and filter a source of pressurized air. The valve body 132 includes an inlet passage 136 into a valve cylinder 138. The inlet passage 136 includes a partially circumferential channel 140 to aid in the flow of air into the valve cylinder 138. The valve cylinder 138 is closed by endcaps 142, one of which is illustrated in FIG. 2.

Figure 9:
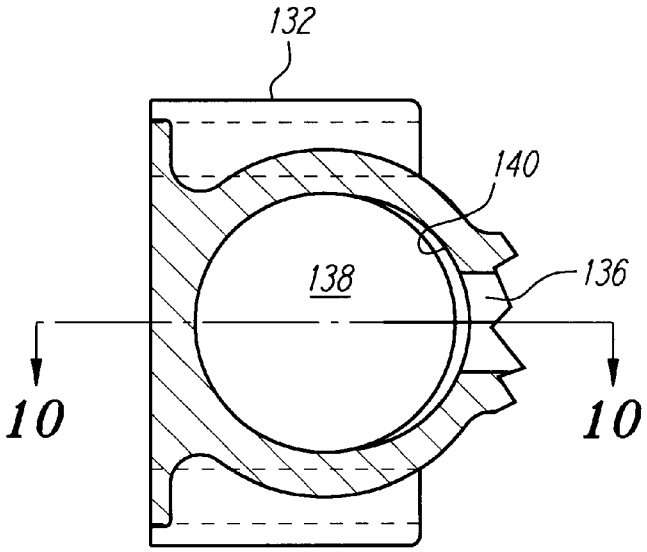
FIG. 9 is a cross-sectional view of the valve cylinder taken along line 9—9 of FIG. 8.
Figure 10:
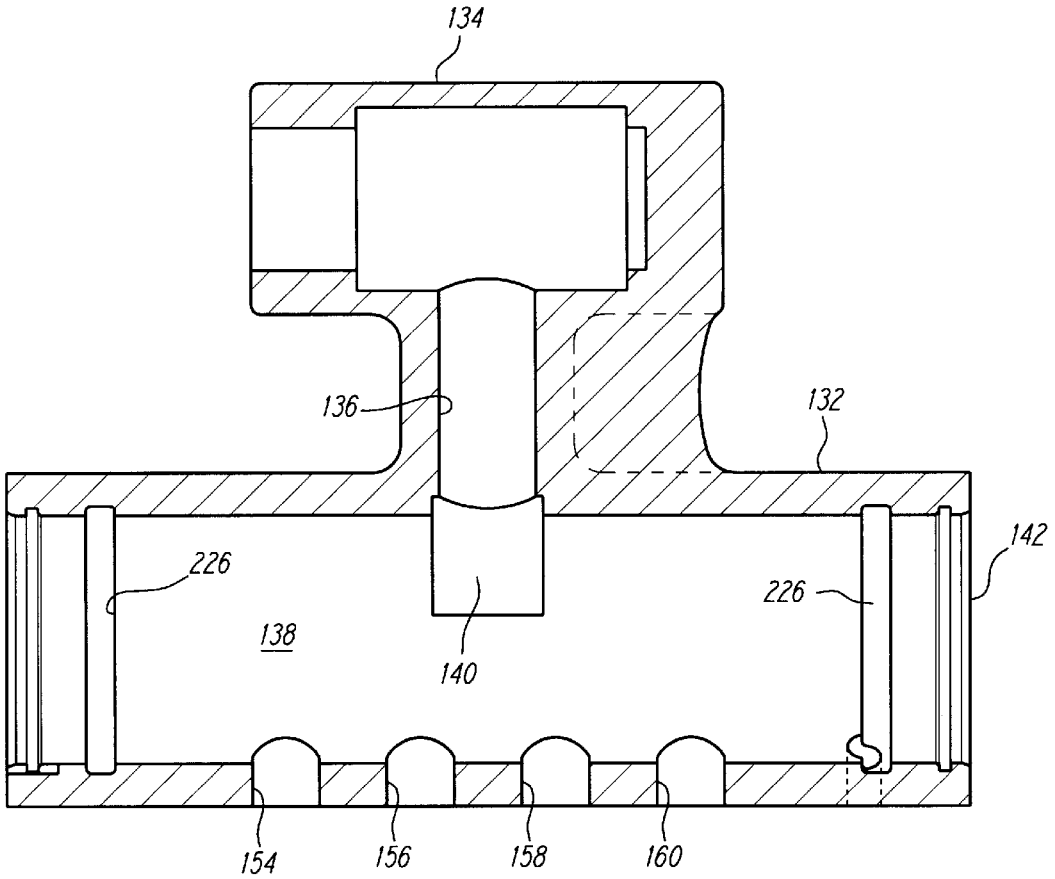
FIG. 10 is a cross-sectional side view of the valve cylinder taken along line 10—10 of FIG. 9.
Figure 11:
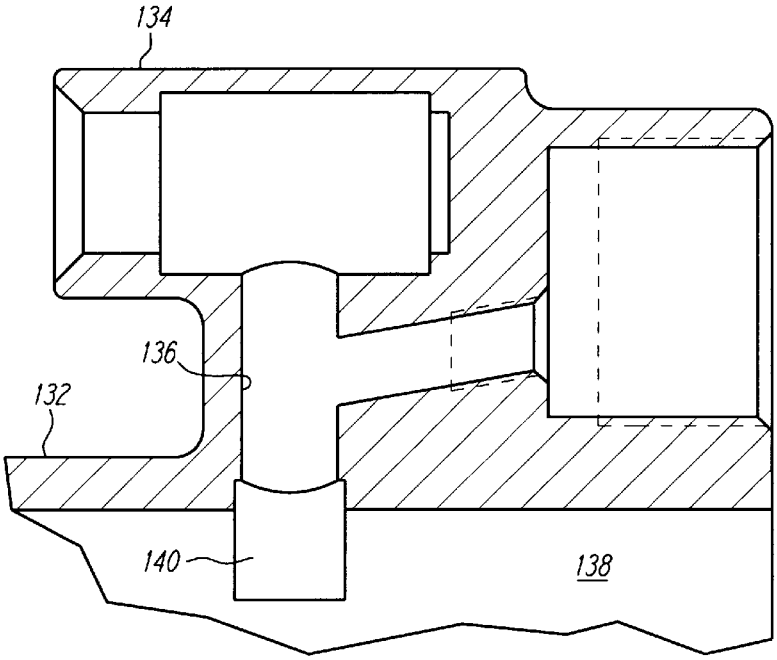
FIG. 11 is a portion of an air cylinder shown in cross section with the additional detail of a lubricating port.
Figure 12:
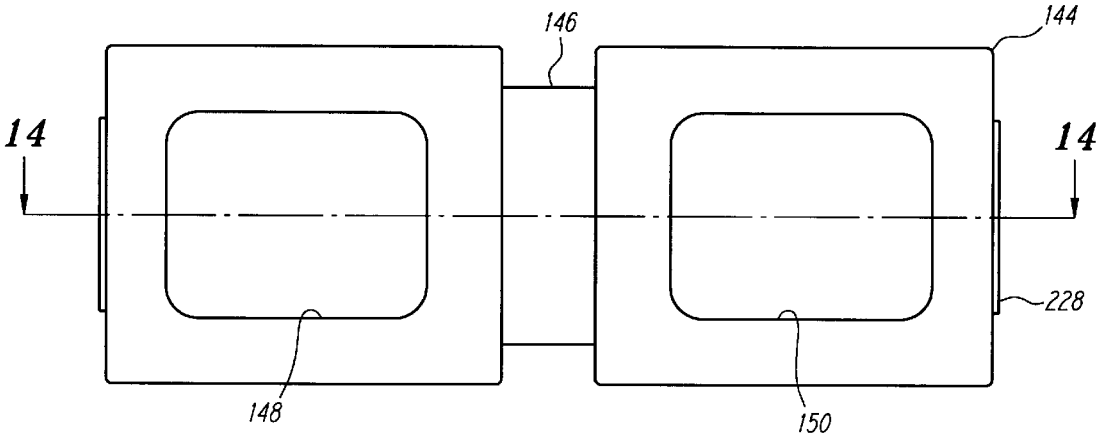
FIG. 12 is a plan view of a valve piston.
Figure 13:
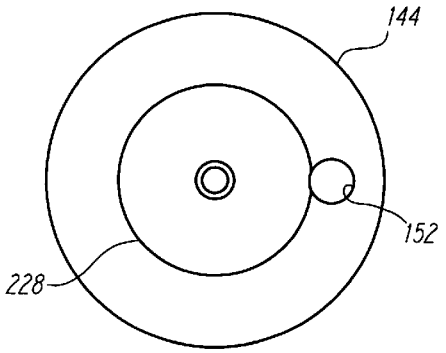
FIG. 13 is an end view of the valve piston.
Figure 14:
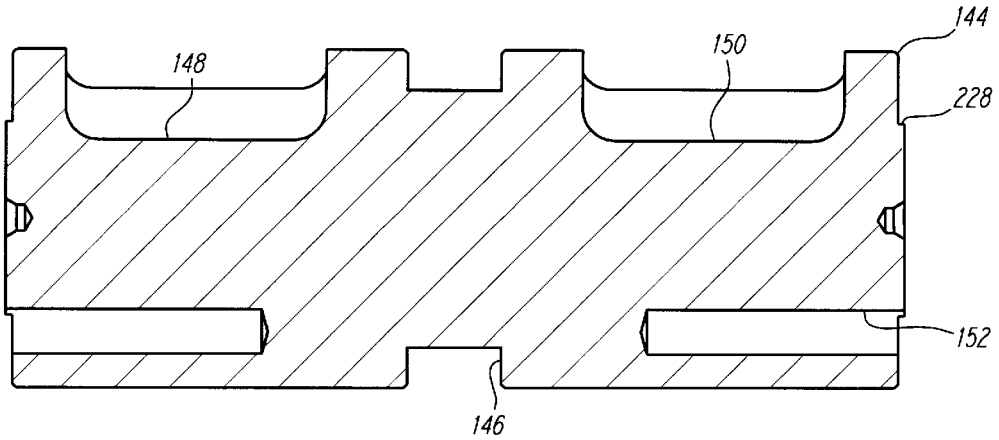
FIG. 14 is a cross-sectional view of the valve piston taken along line 14—14 of FIG. 12.

A valve piston 144, illustrated in FIGS. 12, 13 and 14, is sized to fit within the valve cylinder 138 of FIGS. 9 and 10. The fit of the piston 144 within the cylinder 138 is preferably loose enough so that full inlet pressure may build up at the ends of the piston between strokes. The valve piston 144 includes an annular inlet passage 146. Axial passages 148 and 150 are positioned to either side of the annular inlet passage 146. Indexing holes 152 accommodate a mating pin (not shown) associated with one of the endcaps 142 to keep the piston appropriately indexed within the valve cylinder 138.

The valve body 132 includes ports 154, 156, 158 and 160. These ports 154–160 cooperate with the inlet passage 146 and the axial passages 148 and 150 of the valve piston 144. When the valve piston 144 is in one extreme position at the end of the cylinder 138 nearest the port 154, the annular inlet passage 146 is in communication with the port 156. At the same time, the axial passage 150 is in communication with the ports 158 and 160. With the valve piston 144 in the other extreme position at the end of the cylinder 138 nearest the port 160, the annular inlet passage 146 is then associated with the port 158 and the axial passage 148 is associated with the ports 154 and 156.

To distribute pressurized air to and vent air from the air cavities associated with both the diaphragms 86 and the power amplifier piston 124, a manifold, generally designated 162, is positioned between the valve cylinder 138 and the center section assembly 104. The manifold 162 includes ports 164, 166, 168 and 170 on the top surface thereof. These ports match up with ports 154 through 160, respectively, on the valve cylinder 138. An exhaust passage 172 extends partly through the body of the manifold 162. The ports 164 and 170 extend to this exhaust passage 172 which exhausts to atmosphere. Ports 166 and 168 extend to distribution passages 174 and 176, respectively. These distribution passages 174 and 176 each extend to near opposite ends of the manifold 162. Passage 174 exits to the underside of the manifold 162 through ports 178 and 180. Similarly, distribution passage 176 extends to ports 182 and 184. The ports 178 and 182 couple with tubes 84 leading to the air chamber housings 82. Ports 180 and 184 are coupled with tubes 186 which extend to the center section assembly 104 on either side of the power amplifier piston 124. A port 187 in the cylindrical housing 108 accommodates a fitting 188 associated with one of the tubes 186.

Two pressure relief valves, generally designated 189, are engaged with each side of the center section assembly 104 in threaded holes 190. Actuators 191 extend from the pressure relief valves 189 from either side toward the power amplifier piston 124. The extent to which the actuators 191 extend into the path of travel of the power amplifier piston 124 provides preselected limits on the piston stroke. Adjustments may be made by rotating the pressure relief valves 189 within the holes 190 provided in the center section assembly 104.

Figure 15:
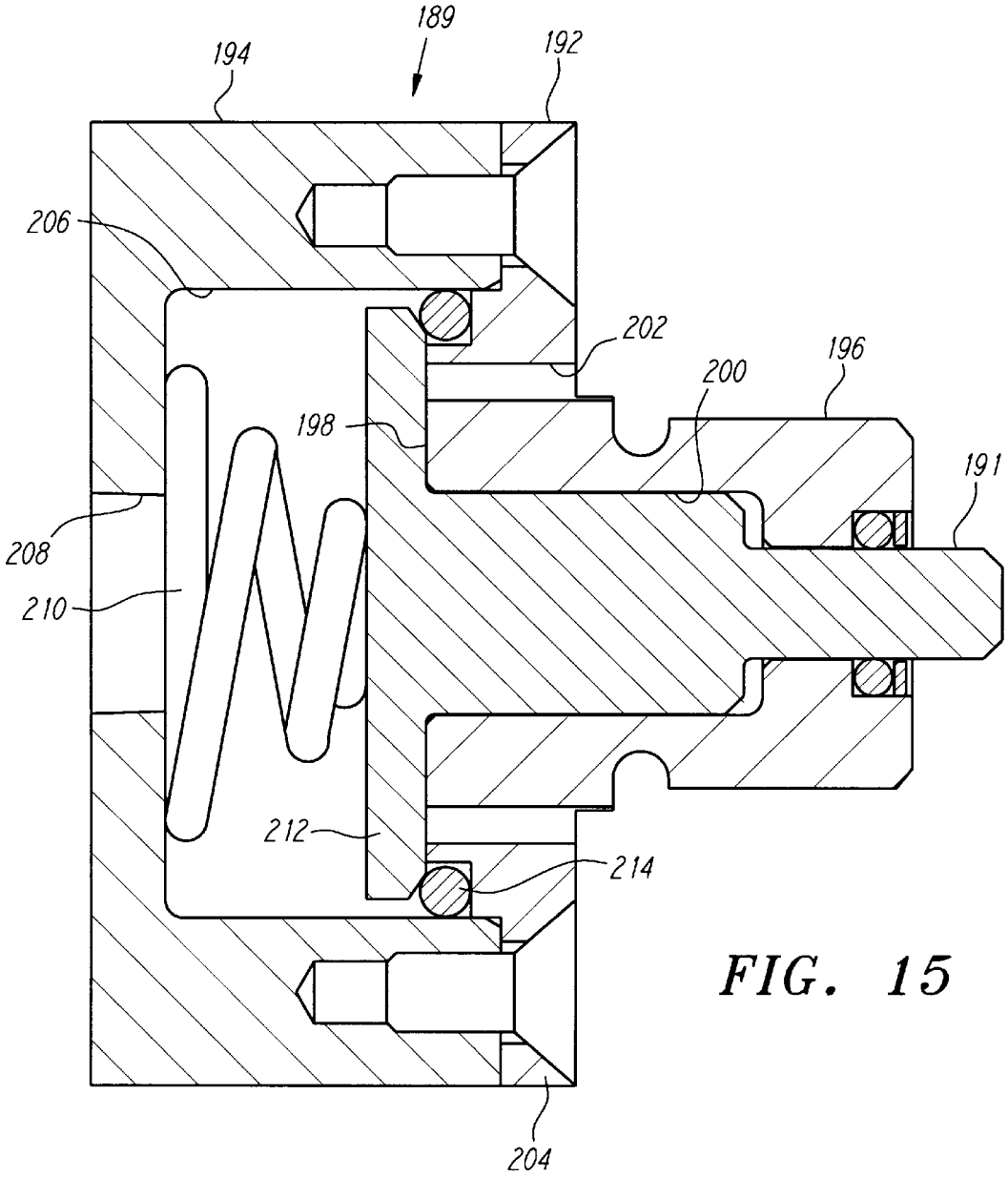
FIG. 15 is a cross-sectional view of a pressure relief valve.
Figure 16:
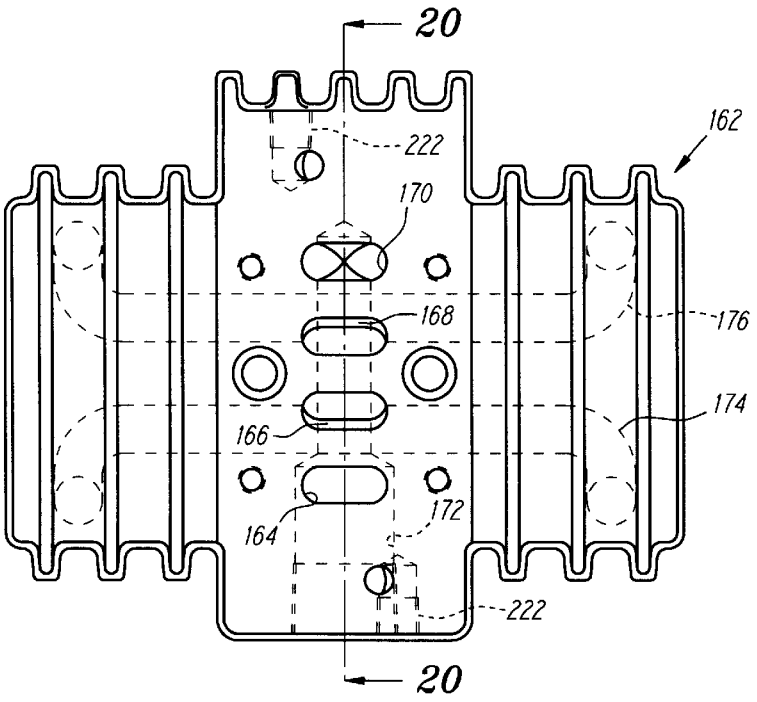
FIG. 16 is a plan view of a manifold.
Figure 17:
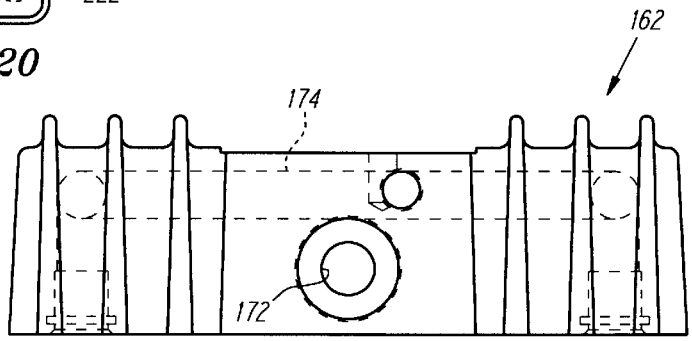
FIG. 17 is a side view of the manifold.
Figure 18:
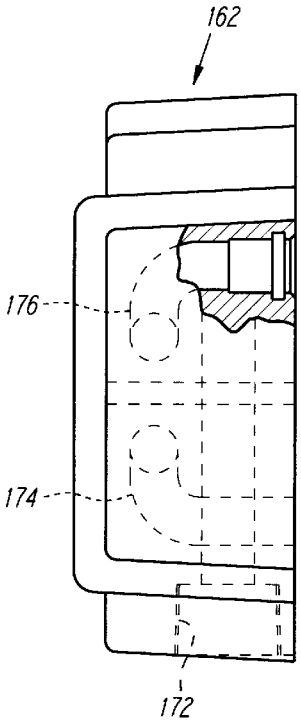
FIG. 18 is an end view of the manifold.
Figure 19:
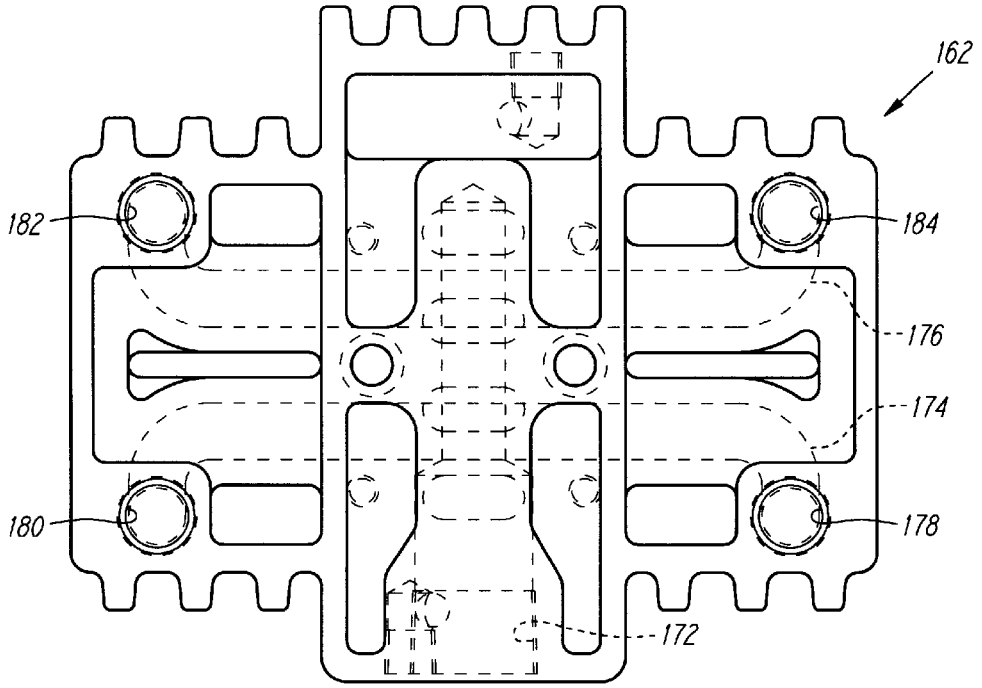
FIG. 19 is a bottom view of the manifold.
Figure 20:
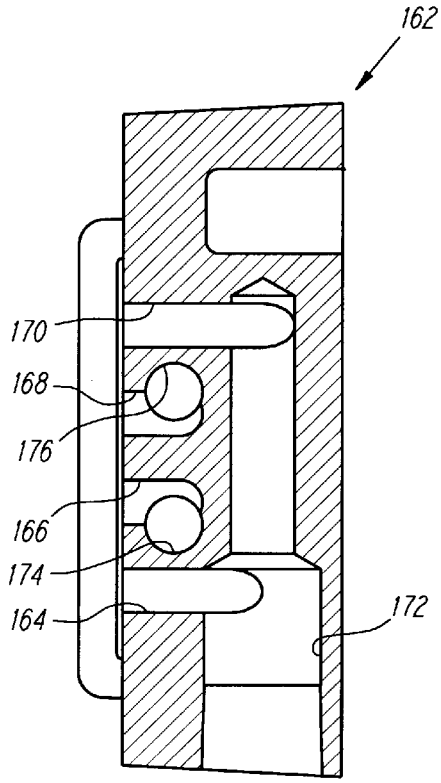
FIG. 20 is a cross-sectional view of the manifold taken along line 20—20 of FIG. 16.

One of the pressure relief valves 189 is illustrated in FIG. 15. The valve 189 includes a first valve body portion 192 and a second valve body portion 194. The first valve body portion 192 includes a threaded stud 196 for threaded association with the center section assembly 104. The first valve body portion 192 also includes a valve seat 198 having a central cavity 200 to receive the actuator 191. The central cavity 200 extends through both the valve seat 198 and the threaded stud 196 to allow the actuator 191 to extend from the end of this threaded stud 196 for engagement with the power amplifier piston 124. Vent passages. 202 are arranged in the valve seat 198 to vent toward atmosphere. An attachment flange 204 extends outwardly from the valve seat 198. Through the attachment flange 204, the first valve body portion 192 may be fastened to the second valve body portion 194. The second valve body portion 194 provides a chamber 206 within which the actuator 191 may move. Displaced from the actuator 191 through the second valve body portion 194 is a threaded hole 208 through which pressure may be supplied to the chamber 206. A coil spring 210 biases the actuator 191 such that the protruding portion extends outwardly of the threaded stud 196 and a sealing flange 212 extends over the vent passages 202. The first valve body portion 192 provides a channel for an O-ring 214 with which the outer periphery of the sealing flange 212 of the actuator 191 cooperates.

Figure 21:
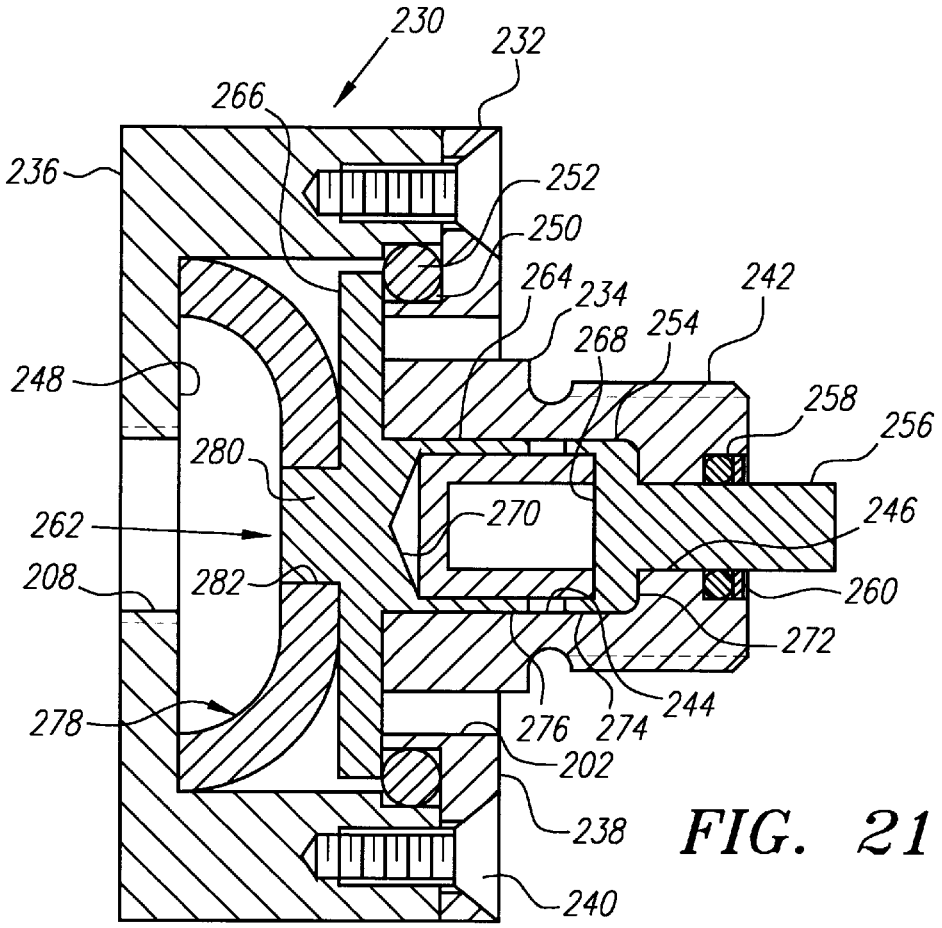
FIG. 21 is a cross-sectional view of a second pressure relief valve.
Figure 22:
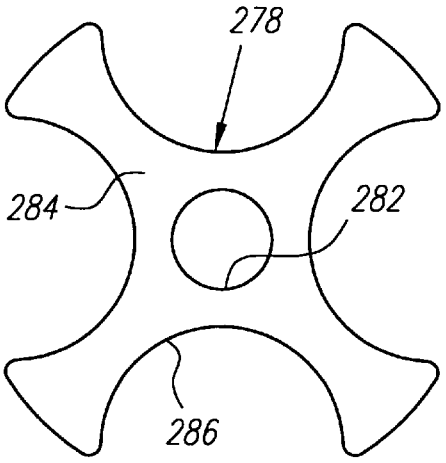
FIG. 22 is a plan view of an unstressed return spring employed in the valve of FIG. 22.
Figure 23:
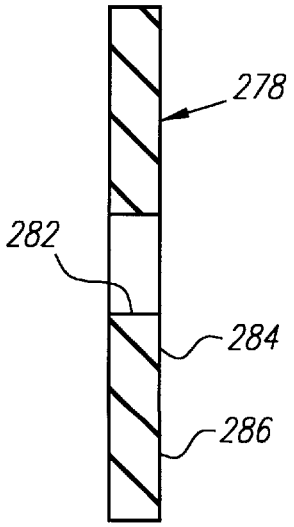
FIG. 23 is a cross-sectional view of the spring taken along line 23—23 of FIG. 22.

A second pressure relief valve, generally designated 230, is illustrated in FIGS. 21 through 23. The same reference numerals as applied to the relief valve illustrated in FIG. 15 are applied where appropriate. Two of the relief valves 230 would be appropriately employed with each side of the center section assembly 104 in the threaded holes 190.

The relief valve 230 includes a valve body 232 assembled from a valve guide 234 and a valve chamber 236. The valve guide 234 includes a radially extending flange 238 to meet with the periphery of the valve chamber 236 for attachment using machine screws 240. The valve guide 234 is threaded about the periphery of the body 242 for assembly with the threaded holes 190. The valve guide 234 includes a guideway 244 which is conveniently cylindrical. The guideway 244 is restricted at one end and includes an access port 246 through that restricted end. The valve chamber 236 defines a cavity 248 which may also be conveniently cylindrical and which is diametrically larger than the guideway 244. The guideway 244 extends to the cavity 248. The valve chamber 236 includes a threaded hole 208 through which pressure may be supplied from the valve cylinder 132.

An annular cavity 250 is defined between the valve guide 234 and the valve chamber 236. The cavity 250 receives an O-ring 252 which may protrude from the surface of the valve guide 234 which faces on the cavity 248. This surface along with the O-ring 252 define a valve seat outwardly of the guideway. Vent passages 202 also extend through the wall facing on the cavity 248 to provide exhaust. The vent passages 202 are inwardly of the O-ring 252. A flow path is defined in the relief valve from the hole 208, through the cavity 248, across the O-ring 252 defining the valve seat and from the vent passages 202.

An actuator 254 is positioned within the guideway 244 against the restricted end. The actuator 254 is mounted within the guideway 244 such that it may slide within the guideway. An actuator pin 256 extends through the access port 246. An O-ring seal 258 retained by a snap ring 260 provides a seal about the actuator pin 256. The actuator pin 256 as employed in the present embodiment is intended to extend into the path of travel of the piston body 128. To insure longevity of the pump, the actuator is adjusted to interfere with the path of travel of the piston body 128 to a greater degree than is required for marginal operation. This accommodates wear and anomalies.

A valve element, generally designated 262, is also located within the valve body 232. The valve element 262 faces the guideway 244 and includes a cylindrical body 264 extending slidably into the guideway 244. A disk 266 extends radially from the cylindrical body 264 and has a first surface facing the cavity 248 and a second surface facing the valve seat so as to seal against the O-ring 252. The disk 266 is within the cavity 248 to receive pressure upon the first surface. The disk 266 is shown to be displaced from the inner wall of the cavity 248. This reduces wear and interference and allows air to pass freely about the outer periphery of the disk.

Both the actuator 254 and the valve element 262 include cylindrical spring seats 268 and 270, respectively. These seats 268 and 270 are open cavities facing one another to receive a compression spring 272. The rims 274 and 276 located about the spring seats 268 and 270, respectively, act as stops to define a rigid compression link between the actuator 254 and the valve element 262 upon compression of the compression spring 272.

The compression spring 272 is shown to be a cylindrical block of material which is hollow and closed at one end. It has been found that an elastomeric material marketed under the trademark HYTREL® by DuPont performs well in this application. The block 272 may be selected from a wide variety of configurations. The configuration as illustrated offers some sealing ability to the chamber defined between spring seats 268 and 270.

A return spring, generally designated 278, is located within the cavity 248 between the valve body 232 and the disk 266 of the valve element 262. This return spring 278 is shown in its relaxed state in FIGS. 22 and 23. A pin 280 located on the valve element 262 cooperates with a hole 282 in the center of the return spring 278 to insure placement. The spring 278 is also preferably of an elastomeric material such as HYTREL® and is arranged within the cavity 248 in a dome shape. The return spring 278 includes a central body 284 about the hole 282 and legs 286 which extend both radially and, when within the cavity 248, are curved axially. Spaces between the legs 286 allow flow from the threaded hole 208 to the valve seat. Because of the flattened dome shape, the spring constant is relatively small through the anticipated movement of the valve element 262. This provides for a relatively predictable return force in spite of manufacturing tolerances and the like. The spring constant then increases substantially beyond this range of movement. The relief spring 278 is also preloaded to establish a bias of the valve element 262 toward seating against the O-ring 252.

At rest, the relief valve 230 has the valve element 262 seated against the O-ring 252 of the valve seat because of the preload compression on the return spring 278. The compression spring 272 may or may not include a preload. However, any preload is appropriately substantially smaller than the preload on the return spring 278 such that the compression force of the return spring 278 dominates. The actuator 254 also extends toward the restricted end of the guideway 244 to its travel limit.

In operation, pressure is contained within the cavity 248 from the hole 208. As the disk 266 is against the O-ring 252, pressure cannot be vented from the device. As the actuator pin 256 is depressed into the valve body 232, this motion is resisted by the pressure within the cavity 248 exerted against the disk 266 on the side facing the cavity. It is also resisted by the return spring 278. A typical pump application would employ shop air having a force exerted across the disk 266 of about 100 lbs. The return spring 278 preferably has a precompression of about 35 lbs. of force.

The force associated with depression of the actuator pin 256 is transmitted to the valve body 262 through the compression spring 272. The compression spring is preferably designed to reach a maximum of about 80 lbs. of force when the rims 274 and 276 engage. The 80 lbs. of force remains as no match to the combined pressure force of about 100 lbs. and return spring force of about 35 lbs. However, once a rigid link is established between the actuor 254 and the valve element 262, force increases substantially instantaneously to in excess of the combined pressure and return spring forces. The disk 266 then moves from the O-ring 252 of the valve seat.

As pressure drops within the cavity 248 and increases on the second side of the disk 266, the compression force of the compression spring 272 becomes dominant. The energy stored within that spring can, therefore, drive the valve element 262 further open. As the compression force of the compression spring 272 reduces with expansion of the spring, it comes into equilibrium with the return spring 278 and remains there until the actuator pin 256 is allowed to extend from the valve body 232. The bias force of the return spring 278 then becomes dominant as the force from the compression spring 272 drops toward zero. The valve element 262 can then return to a seated position. The ranges of compression force thus operating provide for the return spring 278 to have a greater minimum compression force than the compression spring 272 and the compression spring 272 to have a greater maximum force than the return spring 278.

Extending from each of the holes 208 of the pressure relief valves 189 or 230 are elbows 216. The elbows are coupled with flexible tubes 218 which extend to the manifold 162. Elbows 220 are threaded into the manifold 162 at two passages 222. The passages 222 turn 90 degrees to meet the valve cylinder 138 of the valve assembly. Ports 224 extend through the wall of the cylinder to annular grooves 226. Thus, valve control passageways including the tubes 218, the passages 222 and the ports 224 cooperate with the pressure relief valves 189 or 230 to vent the ends of the valve cylinder 138 when the actuator 191 is forced by the power amplifier piston 124 away from the valve seat 198.

Turning to the operation of the double diaphragm pump, it shall be described from rest. With no pressure to the pump, the valve piston 144 will fall to the lower end of the valve cylinder 132 which is preferably arranged with the axis of the valve cylinder 132 in vertical orientation. Pressure will be introduced through the filter 134 and into the inlet passage 136. The annular inlet passage 146 on the valve piston 144 will convey the pressurized air to the port 158. It will then pass into the manifold 162 through the port 168 to the distribution passage 176. From the port 182, the pressure will be conveyed by a tube 84 into one of the air chamber housings 82. The pressurized air presented to the air chamber cavity 83 will put force on the diaphragm 86. Pressure is also conveyed by the port 184 through the tube 186 to one side of the power amplifier piston 124. The pressurized working surfaces of both the diaphragm 86 and the power amplifier piston 124 are facing in the same direction. With the pressure accumulating in one of the air chambers and on a corresponding side of the power amplifier piston, the diaphragms 86, the diaphragm pistons 88 and the control shaft 116 move to compress one of the pump chambers 24 and expand the other. The appropriate check valves open to alternately expel material from and draw material into the pump chambers 26.

During the stroke of the control shaft 116, the pressure relief valves 189 or 230 are closed. The valve piston 144 loosely fits within the valve cylinder 138. Consequently, the pressurized air entering through the inlet passage 136 fully pressurizes the ends of the valve piston 144. The differential pressure diametrically across the valve piston 144 from the inlet passage 136 to the port 158 draws the valve piston 144 against the ports 154, 156, 158 and 160. Additionally, the exhaust passage 172 is open to the ports 154 and 160 which further draws the valve piston 144 against these ports. The axial passage 148 couples the ports 154 and 156 so that, as one side of the power amplifier piston 124 is being pressurized, the other is being vented. At the same time, as one air chamber is being pressurized, the other is being vented.

Once the power amplifier piston 124 reaches one of the actuators 191 or actuator pins 256, the upper end of the valve cylinder 138 is vented through a valve control passageway. As this occurs, a transitory unequal distribution of forces exists axially on the valve piston 144. Because the valve piston 144 has spacers 228 at either end, a small volume of air is present even with the valve piston 144 hard against one end of the valve cylinder 138. This causes the piston to shift to the upper end of the valve cylinder 138, reversing the pressurizing and venting. At this time, the control shaft 116, through the reversal of pressure and vent, moves in the opposite direction. In this way, each cycle continues to create an oscillation of the control shaft 116 and all components associated therewith to alternately pump from each pump cavity 26.

The diaphragm pistons 88, the diaphragms 86 and the power amplifier piston 124 thus cooperate to provide an amplified pressure to each pump cavity 26. With the surface area of the power amplifier piston at approximately twice the active area of each diaphragm piston 88 and diaphragm 86 together, the resulting amplification may be three times that experienced with pressure on the diaphragm 86 and diaphragm piston 88 alone. At the same time, both pump cavities 26 of the double diaphragm pump are able to be used in pumping with each reversal of the control shaft 116 resulting in both a suction stroke on one side and a power stroke on the other. Through the design of the manifold 162, no increased complication is experienced with the control and pressure valving.

Accordingly, an improved amplified pressure air driven diaphragm pump with double working diaphragms is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A double diaphragm pump comprising two opposed pumping cavities;

two diaphragms, each diaphragm extending across a pumping cavity, respectively;

a control shaft assembly extending between each of the diaphragms;

a center section assembly including a cylinder;

a power amplifier piston fixed to the control shaft assembly and in sealing contact slidably positioned in the cylinder;

a valve assembly in fluid communication with both sides of the power amplifier piston and with the pumping cavities;

a manifold fixed to the center section assembly and positioned between the center section assembly and the valve assembly.

2. The double diaphragm pump of claim 1, the two opposed pumping cavities each including an inlet check valve and an outlet check valve, respectively.

3. The double diaphragm pump of claim 1, the pumping cavities being separate structures including fasteners structurally affixing the pumping cavities to the center section assembly.

4. A double diaphragm pump comprising two opposed pumping cavities;

two diaphragms, each diaphragm extending across a pumping cavity, respectively;

a control shaft assembly extending between each of the diaphragms;

a center section assembly including a cylinder;

a power amplifier piston fixed to the control shaft assembly and in sealing contact slidably positioned in the cylinder;

a valve assembly in fluid communication with both sides of the power amplifier piston and with the pumping cavities, the valve assembly including two pressure relief valves fixed to the center section assembly, each with an actuator extending to meet the power amplifier piston at preselected limits of the piston stroke.

5. The double diaphragm pump of claim 4, the valve assembly further including a valve cylinder and a valve piston in the valve cylinder, each pressure relief valve being in fluid communication with an end of the valve cylinder, respectively, venting the respective end of the valve cylinder when the power amplifier piston meets the respective actuator.

6. The double diaphragm pump of claim 5, the valve cylinder being in fluid communication with both sides of the power amplifier piston, with the pumping cavities and with atmosphere, the valve piston controlling the fluid communication of the valve cylinder.

7. The double diaphragm pump of claim 6, the valve assembly further including a first passage extending from the valve cylinder to one of the pumping cavities and to one side of the power amplifier piston and a second passage extending from the valve cylinder to the other of the pumping cavities and to the other side of the power amplifier piston.

8. A double diaphragm pump comprising two opposed pump chamber housings;

two air chamber housings between the opposed pump chamber housings, each air chamber housing facing a pump chamber housing, respectively, to form a pumping cavity;

two diaphragms, each diaphragm extending across a pumping cavity, respectively;

a control shaft assembly extending between and fixed to each of the diaphragms;

a center section assembly including a cylinder having a center axis coincident with the center axis of the control shaft assembly;

a power amplifier piston fixed to the control shaft assembly and in sealing contact slidably positioned in the cylinder;

a valve assembly in fluid communication with both sides of the power amplifier piston and with the pumping cavities at the air chamber housings;

a manifold fixed to the center section assembly and positioned between the center section assembly and the valve assembly.

9. The double diaphragm pump of claim 8, the two opposed pump chamber housings each including an inlet check valve and an outlet check valve, respectively.

10. The double diaphragm pump of claim 8, the control shaft assembly including a control shaft and two diaphragm pistons at each end of and fixed to the control shaft, respectively, each diaphragm piston being fixed to one of the diaphragms, respectively.

11. The double diaphragm pump of claim 10, the control shaft being in two portions with the portions fixed together and holding the center of the power amplifier piston.

12. The double diaphragm pump of claim 8, the air chamber housings being separate structures including fasteners structurally affixing the air chamber housings to the center section assembly.

13. A double diaphragm pump comprising two opposed pump chamber housings;

two air chamber housings between the opposed pump chamber housings, each air chamber housing facing a pump chamber housing, respectively, to form a pumping cavity;

two diaphragms, each diaphragm extending across a pumping cavity, respectively;

a control shaft assembly extending between and fixed to each of the diaphragms;

a center section assembly including a cylinder having a center axis coincident with the center axis of the control shaft assembly;

a power amplifier piston fixed to the control shaft assembly and in sealing contact slidably positioned in the cylinder;

a valve assembly in fluid communication with both sides of the power amplifier piston and with the pumping cavities at the air chamber housings, the value assembly including two pressure relief valves fixed to the center section, each with an actuator extending to meet the power amplifier piston at preselected limits of the piston stroke.

14. The double diaphragm pump of claim 13, the valve assembly further including a valve cylinder and a valve piston in the valve cylinder, each pressure relief valve being in fluid communication with an end of the valve cylinder, respectively, venting the respective end of the valve cylinder when the power amplifier piston meets the respective actuator.

15. The double diaphragm pump of claim 14, the valve cylinder being in fluid communication with both sides of the power amplifier piston, with the pumping cavities at the air chamber housings and with atmosphere, the valve piston controlling the fluid communication of the valve cylinder.

16. The double diaphragm pump of claim 15, the valve assembly further including a first passage extending from the valve cylinder to one of the pumping cavities through the corresponding air chamber housing and to one side of the power amplifier piston and a second passage extending from the valve cylinder to the other of the pumping cavities through the corresponding air chamber housing and to the other side of the power amplifier piston.

17. A double diaphragm pump comprising two opposed pump chamber housings;

two air chamber housings between the opposed pump chamber housings, each air chamber housing facing a pump chamber housing, respectively, to form a pumping cavity;

two diaphragms, each diaphragm extending across one of the pumping cavities, respectively;

a control shaft assembly extending between and fixed to each of the diaphragms, the control shaft assembly including a control shaft and two diaphragm pistons at each end of and fixed to the control shaft, respectively, each diaphragm piston being fixed to one of the diaphragms, respectively;

a center section assembly including a cylinder having a center axis coincident with the center axis of the control shaft assembly;

a power amplifier piston fixed to the control shaft assembly and in sealing contact slidably positioned in the cylinder;

a valve assembly in fluid communication with both sides of the power amplifier piston and with the pumping cavities at the air chamber housings, the valve assembly including two pressure relief valves fixed to the center section, each with an actuator extending to meet the power amplifier piston at preselected limits of the piston stroke, a valve cylinder, a valve piston in the valve cylinder, each pressure relief valve being in fluid communication with an end of the valve cylinder, respectively, venting the respective end of the valve cylinder when the power amplifier piston meets the respective actuator, the valve cylinder being in fluid communication with both sides of the power amplifier piston, with the pumping cavities at the air chamber housings and with atmosphere, the valve piston controlling the fluid communication of the valve cylinder, a first passage extending from the valve cylinder to one of the pumping cavities through the corresponding air chamber housing and to one side of the power amplifier piston and a second passage extending from the valve cylinder to the other of the pumping cavities through the corresponding air chamber housing and to the other side of the power amplifier piston.

18. The double diaphragm pump of claim 17, the air chamber housings being separate structures including fasteners structurally affixing the air chamber housings to the center section assembly.

19. A double diaphragm pump comprising two opposed pump chamber housings;

two air chamber housings between the opposed pump chamber housings, each air chamber housing facing a pump chamber housing, respectively, to form a pumping cavity;

two diaphragms, each diaphragm extending across one of the pumping cavities, respectively;

a control shaft assembly extending between and fixed to each of the diaphragms and including a control shaft and two diaphragm pistons at each end of and fixed to the control shaft, respectively, each diaphragm piston being fixed to one of the diaphragms, respectively;

a center section assembly including a cylinder having a center axis coincident with the center axis of the control shaft assembly, the air chamber housings being separate structures including fasteners structurally affixing the air chamber housings to the center section assembly;

a power amplifier piston fixed to the control shaft assembly and in sealing contact slidably positioned in the cylinder;

a valve assembly in fluid communication with both sides of the power amplifier piston and with the pumping cavities at the air chamber housings.

20. The double diaphragm pump of claim 19 further comprising a manifold fixed to the center section assembly, the valve assembly being fixed to the manifold with the manifold positioned between the center section assembly and the valve assembly.

21. A double diaphragm pump comprising two opposed pumping cavities;

two diaphragms, each diaphragm extending across a pumping cavity, respectively;

a control shaft assembly extending between each of the diaphragms and being slidably mounted relative to the opposed pumping cavities;

a valve assembly in fluid communication with the pumping cavities including two pressure relief valves, each with an actuator pin extending to be alternately depressed at preselected limits of the control shaft assembly stroke, each valve assembly including a valve body having a cavity therein, a guideway extending to the cavity, a valve seat in the cavity and a flow path through the cavity and across the valve seat to exhaust, an actuator slidably positioned in the guideway with the actuator pin, a valve element slidably positioned in the valve body within the cavity, facing the guideway and slidable into and biased toward seating engagement with the valve seat, and a compression spring between the actuator and the valve element.

22. A double diaphragm pump comprising two opposed pumping cavities;

two diaphragms, each diaphragm extending across a pumping cavity, respectively;

a control shaft assembly extending between each of the diaphragms;

a center section assembly including a cylinder;

a power amplifier piston fixed to the control shaft assembly and slidably positioned in the cylinder;

a valve assembly in fluid communication with both sides of the power amplifier piston and with the pumping cavities, the valve assembly including two pressure relief valves fixed to the center section assembly, each with an actuator pin extending to meet the power amplifier piston at preselected limits of the piston stroke, each pressure relief valve including a valve body having a cavity therein, a guideway extending to the cavity, a valve seat in the cavity and a flow path through the cavity and across the valve seat to exhaust, an actuator slidably positioned in the guideway with the actuator pin, a valve element slidably positioned in the valve body within the cavity, facing the guideway and slidable into and biased toward seating engagement with the valve seat, and a compression spring between the actuator and the valve element.

23. The double diaphragm pump of claim 22, the pressure relief valve further including a return spring between the valve body and the valve element to bias the valve element toward seating engagement with the valve seat.

24. The double diaphragm pump of claim 23, the return spring including a central body with legs radiating outwardly and curved axially therefrom to form a dome shape.

25. The double diaphragm pump of claim 23, the return spring being of elastomeric material.

26. The double diaphragm pump of claim 23, the return spring being in compression between the valve body and the valve element.

27. The double diaphragm pump of claim 23, the return spring being in the cavity.

28. The double diaphragm pump of claim 23, the return spring having a spring constant which is nonlinear and of increasing value with compression.

29. The double diaphragm pump of claim 23, the compression spring having a first range of compression force throughout the operation thereof and the return spring having a second range of compression force throughout the operation thereof, the highest force in the first range being substantially greater than the highest force in the second range, the lowest force in the first range being substantially less than the lowest force in the second range.

30. The double diaphragm pump of claim 22, the guideway having a restricted end with an access port through the restricted end.

31. The double diaphragm pump of claim 30, the actuator including an actuator pin extending from the access port.

32. The double diaphragm pump of claim 22, the valve element extending into the guideway from the cavity, at least one of the actuator and the valve element including a spring seat to receive the compression spring and a stop to encounter the other of the actuator and the valve element with the compression spring compressed.

33. The double diaphragm pump of claim 32, the spring seat being an open cavity and the stop being a rim about the open cavity.

34. The double diaphragm pump of claim 33, the compression spring being a block of elastomeric material.

35. The double diaphragm pump of claim 34, the compression spring cylinder being hollow and closed at one end.

36. The double diaphragm pump of claim 22, the valve seat being circumferentially about the guideway, the valve element including a disc extending radially to adjacent the valve seat and having a first side facing the cavity and a second side facing the valve seat.

37. A double diaphragm pump comprising two opposed pumping cavities;

two diaphragms, each diaphragm extending across a pumping cavity, respectively;

a control shaft assembly extending between each of the diaphragms;

a center section assembly including a cylinder;

a power amplifier piston fixed to the control shaft assembly and slidably positioned in the cylinder;

a valve assembly in fluid communication with both sides of the power amplifier piston and with the pumping cavities, the valve assembly including two pressure relief valves fixed to the center section assembly, each with an actuator pin extending to meet the power amplifier piston at preselected limits of the piston stroke, each valve body including a cavity therein, a guideway extending to the cavity, a valve seat in the cavity circumferentially about the guideway, and a flow path through the cavity and across the valve seat to exhaust, an actuator slidably positioned in the guideway with the actuator pin, a valve element slidably positioned in the valve body within the cavity, facing the guideway and slidable into seating engagement with the valve seat, the valve element including a disc extending radially to adjacent the valve seat and having a first side facing the cavity and a second side facing the valve seat, a compression spring between the actuator and the valve element, the compression spring having a first range of compression force throughout the operation thereof, a return spring between the valve body and the valve element biasing the valve element toward seating engagement with the valve seat, the return spring having a second range of compression force throughout the operation thereof, the highest force in the first range being substantially greater than the highest force in the second range, the lowest force in the first range being substantially less than the lowest force in the second range.

38. The double diaphragm pump of claim 37, the valve element slidably extending into the guideway from the cavity, at least one of the actuator and the valve element including a spring seat to receive the compression spring and a stop to encounter the other of the actuator and the valve element with the compression spring compressed.

39. The double diaphragm pump of claim 37, the spring seat being an open cavity and the compression spring being a block of elastomeric material.

40. The double diaphragm pump of claim 39, the compression spring cylinder being hollow and closed at one end.

41. The double diaphragm pump of claim 39, the relief valve further including a return spring between the valve body and the valve element to bias the valve element toward seating engagement with the valve seat.

42. The double diaphragm pump of claim 41, the return spring including a central body with legs radiating outwardly and curved axially therefrom to form a dome shape.

43. The double diaphragm pump of claim 42, the return spring being of elastomeric material.

44. A double diaphragm pump comprising two opposed pumping cavities;

two diaphragms, each diaphragm extending across a pumping cavity, respectively;

a control shaft assembly extending between each of the diaphragms;

a center section assembly including a cylinder;

a power amplifier piston fixed to the control shaft assembly and slidably positioned in the cylinder;

a valve assembly in fluid communication with both sides of the power amplifier piston and with the pumping cavities, the valve assembly including two pressure relief valves fixed to the center section assembly, each with an actuator pin extending to meet the power amplifier piston at preselected limits of the piston stroke, each pressure relief valve including a valve body including a cavity therein, a guideway extending to the cavity, a valve seat in the cavity, and a flow path through the cavity and across the valve seat to exhaust, an actuator slidably positioned in the guideway with the actuator pin, a valve element slidably positioned in the valve body within the cavity, extending into the guideway and slidable into and biased toward seating engagement with the valve seat, a compression spring between the actuator and the valve element, at least one of the actuator and the valve element including a spring seat to receive the compression spring and a stop to encounter the other of the actuator and the valve element with the compression spring compressed.

* * * * *

UNITED STATES PATENT AND TRADEMARK OFFICE

CERTIFICATE OF CORRECTION

PATENT NO. : 5,927,954
DATED : July 27, 1999
INVENTOR(S) : Kennedy et al.

It is certified that error appears in the above-identified patent and that said Letters Patent is hereby corrected as shown below:

In claim 13 (Col. 11, l. 66), delete "value" and insert therefor -- valve --.

Signed and Sealed this
First Day of February, 2000

*Attest:*

Q. TODD DICKINSON

*Attesting Officer*

*Acting Commissioner of Patents and Trademarks*